United States Patent [19]

Russo

[11] 4,240,592

[45] Dec. 23, 1980

[54] RETRIEVING APPARATUS FOR TETHERED SPORTS MISSILE

[76] Inventor: Andrew N. Russo, 96 Main St., Everett, Mass. 02149

[21] Appl. No.: 91,075

[22] Filed: Nov. 5, 1979

[51] Int. Cl.[3] ..... A63B 69/36

[52] U.S. Cl. ..... 242/54 R; 273/184 B; 273/200 R

[58] Field of Search ..... 242/54 R, 54 A, 84.1 A, 242/84.21 R, 85; 273/200 R, 179 R, 200 A, 184 B, 185 R; 43/43.11, 25

[56] References Cited

U.S. PATENT DOCUMENTS

| | | | |
|---|---|---|---|
| 2,714,009 | 7/1955 | Noland | 242/84.2 R X |
| 3,191,880 | 6/1965 | Visconti | 242/54 R |
| 3,707,268 | 12/1972 | Kelly | 242/54 R |
| 3,826,439 | 7/1974 | Moon | 242/54 R |
| 4,125,230 | 11/1978 | Fischer | 273/184 B |

*Primary Examiner*—Edward J. McCarthy
*Attorney, Agent, or Firm*—Kenway & Jenney

[57] ABSTRACT

Apparatus for retrieving a tethered sports missile has a horizontal spool element of relatively large diameter and a hooplike line-guiding element arranged for deployment substantially concentric with the spool element and transverse to the spool axis and well spaced from the spool. A missile-tethering line feeds off the spool element directly to the line-guiding hoop. A selectively operable motor element rewinds the tethering line onto the spool by way of a second line guide through which the line selectively feeds from the first line-guiding element during retrieval. A line metering element is preferably provided.

11 Claims, 2 Drawing Figures

RETRIEVING APPARATUS FOR TETHERED SPORTS MISSILE

BACKGROUND OF THE INVENTION

This invention relates to apparatus for retrieving a tethered golf ball or other sports missile.

One feature of the retriever is the geometry of the line-spooling and the line-guiding elements which allows the line to pay out with minimal drag. The retriever accordingly is advantageously used where the distance which the ball or other missile travels is important. The retriever of the invention is accordingly well suited for retrieving golf balls, for it enables a golfer realistically to practice a variety of strokes, whether for putting, driving or shots of intermediate distance. The retriever which the invention provides is also suited for use with other sports missiles, including hockey pucks, footballs, baseballs, tennis balls, and the like.

Apparatus for retrieving tethered balls is known, as illustrated in U.S. Pat. No. 3,826,439. The golf ball retriever of that patent employs a fishing rod-type spinning reel from which the line feeds through numerous guides and control elements. U.S. Pat. No. 4,125,230 describes a golf ball retriever which has a relatively complex arrangement of driven and control elements for storing and for paying out the tethering line. Additional prior art is found in U.S. Pat. Nos. 1,399,293; 3,340,735; and 4,092,027.

An object of this invention is to provide an improved retriever for a tethered sports missile, and particularly a retriever which imposes minimal hinderance on the missile whether in the form of drag or in the anchorage of the tether to the missile. A more specific object is to provide a retriever for a tethered sports missile which pays out the tethering line with minimal drag, and in particular without any powered elements.

Another object is to provide a retriever having the foregoing features which readily can meter the distance the sports missile travels.

Other objects are that the retriever be easy to use and yet compact to store and transport.

Other objects of the invention will in part be obvious and will in part appear hereinafter.

SUMMARY OF THE INVENTION

According to the invention, a retriever of a tethered sports missile, an example of which is a golf ball, has a relatively large and horizontal spool mounted on a base housing and selectively driven for taking up a tethering line. A line guide with essentially minimal line-engaging surface, an example of which is a hoop, is mounted substantially concentric with the spool and generally parallel to it, but spaced a significant distance above the spool. A collapsible support structure is mounted on the housing for deploying the line guide in this geometrical configuration relative to the spool. When collapsed for storage and transport, however, the supporting structure and the line guide are compactly disposed with the spool on the housing.

A second line guide is aligned for guiding the tethering line to feed in from the first guide onto the circumference of the spool, when a drive unit rotates the spool. The second line guide is of the type with which the line is readily manually disengaged and re-engaged.

This arrangement of line-guiding and spooling elements allows the missile-tethering line to feed directly upward from the spool and within the relatively large line guide disposed above it for paying out the line with high freedom from drag when the missile is hit or thrown. No elements are powered, and hence the spool is stationary, during this line-casting operation. Conversely, the line readily feeds in and winds on the spool when the line is threaded through the second line guide and the spool is driven for retrieval. A metering unit is readily provided for measuring the length of line being retrieved, and thereby measuring the distance which the sports missile travelled.

The foregoing construction and arrangement of the retriever is characterized by a high degree of simplicity, relatively few moving parts, ease in set-up and in operation, and relatively compact storage and transport. Moreover, the retriever allows a golf ball, baseball, hockey puck, or other sports missile to travel with minimal drag from the tether. This enables the retriever to be used to advantage in instances where the distance which the missile travels is important. This use is enhanced by the ease with which the retriever can employ a line metering device.

Another feature of the invention resides in the anchorage of the line to a sports missile, such as a golf ball, which has a body of thermoplastic material. The invention provides secure fastening to such a missile with a barbed shaft that is heated sufficiently to melt the material of the missile and pressed into the missile while hot. The material of the missile melts to admit the shaft and then resolidifies. The shaft is thereby securely anchored in the missile, with its barb or like structure resisting dislodgment. An eyelet on the exposed end of the barbed shaft secures the tethering line to the shaft.

The invention accordingly comprises the features of construction, combination of elements, and arrangement of parts exemplified in the construction hereinafter set forth, and the scope of the invention is indicated in the claims.

BRIEF DESCRIPTION OF THE DRAWINGS

For a fuller understanding of the nature and objects of the invention, reference should be had to the following detailed description, taken in connection with the accompanying drawings, in which.

DESCRIPTION OF ILLUSTRATED EMBODIMENT

Figure 1:
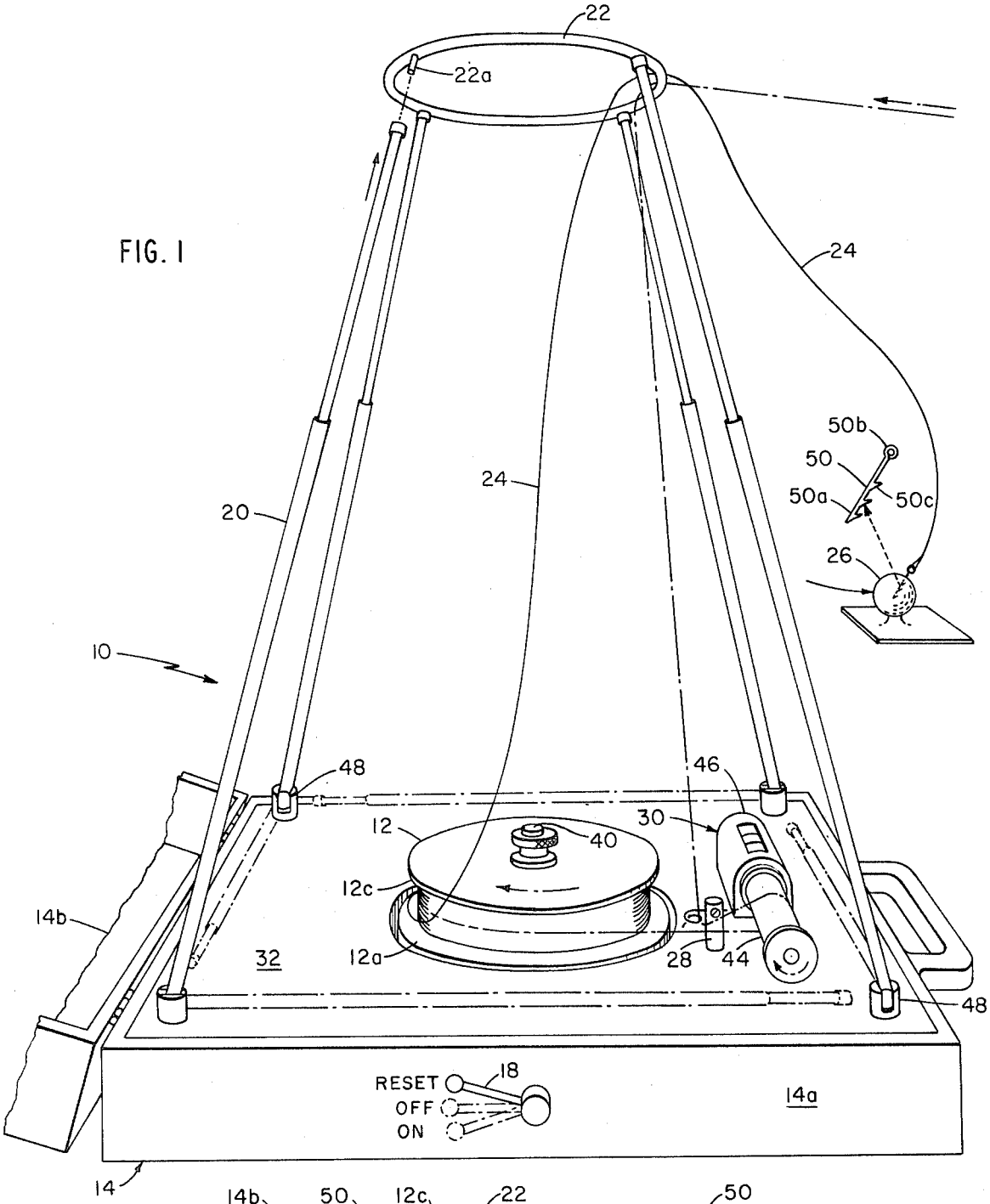
FIG. 1 is a fragmentary isometric showing of a golf ball retriever embodying features of the invention.

With reference to the drawings, a sports retriever indicated generally at 10 according to the invention has a horizontal spool 12 mounted on a housing 14 and coupled with a housing-mounted drive unit 16 for rotation when a switch 18 is placed in the ON position. Spaced above the horizontal spool 12, on a collapsible support provided by telescopic legs 20, is a horizontal hoop-like line guide 22. A line 24, anchored at one end to the spool and wound on it, extends upward from the spool through the line guide and is fastened at the free end to a golf ball 26.

When the golf ball is hit, the line automatically pays out by lifting upward from the horizontal spool 12 and unwinding as it is drawn through the elevated horizontal line guide 22. (The solid line showing of the line 24 in FIG. 1 is with the golf ball 26 at rest ready to be hit.) To retrieve the golf ball, the line 24 is threaded through a second line guide 28. This guide is arranged to feed the line directly to the spool 12 or, when the user wants to measure the distance the golf ball travels, to a metering unit 30 and then onto the spool. When the line is threaded in either manner and the switch 18 placed in the ON position, the drive unit powers the spool to wind up the line and thereby retrieve the golf ball 26. The user readily removes the line from the metering unit 30 and from the second line guide 28 to ready the retriever for another hit of the golf ball.

Figure 2:
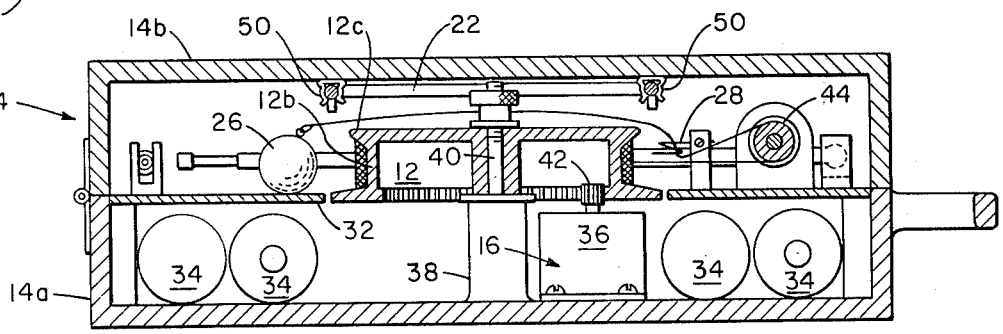
FIG. 2 is a side elevation view, partly in section, of the retriever of FIG. 1 closed for transport and storage.

More particularly, the illustrated retriever 10 has an attache-like case which forms the housing 14. The elements of the retriever are mounted with the case bottom 14*a*, to which is hinged a case top 14*b*. When the top is closed, as shown in FIG. 2, the case completely encloses the retriever. The bottom of the case mounts a deck panel 32 spaced above the bottom panel. In the intervening compartment is mounted the drive unit 16, which as illustrated includes electric storage batteries 34 connected by way of the switch 18 to an electric motor and gear assembly 36.

The housing 14 which the case forms is arranged to be generally horizontal when the retriever is deployed, as shown in FIG. 1. In this position, the spool 12 is generally horizontal with a correspondingly generally vertical rotation axis. Similarly, the primary line guide 22 is generally horizontal and spaced vertically above spool 12. The illustrated housing 14 mounts the spool 12 for rotation about the spool axis on a fixed pedestal 38 that disposes the spool lower flange 12*a* substantially at the level of the deck panel 32. A shaft 40 axially extending from the pedestal 38 carries the spool 12 for this rotation. The illustrated spool is driven by a drive wheel 42 which engages the spool inner circumferential rim and is carried on the output shaft of the motor and gear assembly 36.

The spool has a right cylindrical outer circumferential surface 12*b* on which the line 24 winds and which is bounded by the lower rim 12*a* and an upper rim 12*c*, as shown. The angle between the cylindrical spool surface 12*b* and the upper rim 12*c* is obtuse and preferably is in the order of one and one-half pi radians, i.e. 135°. With this relatively large angle, the upper rim 12*c* retains line from accidentally spilling off the spool but allows the line to feed from the spool with low drag when the golf ball 26 or other missile attached to the free end of the line is hit or thrown.

With further reference to the drawings, the illustrated second line guide 28 provides a closed loop for guiding the line 24 but is of an open spiral construction that allows the line readily to be released from it and, conversely, engaged with it. The second line guide 28 is located above the housing deck panel 32 to feed the line directly to the circumference of the spool. Alternatively, the line guide 28 feeds the line to the metering unit 30, from which the line feeds to the spool circumference. The illustrated metering unit 30 employs a rotatable actuator stem 44 around which the line can be wrapped to rotate the stem without relative slippage as the line is wound onto the spool during line-retrieving operation. The stem is coupled with a resettable counter 46 for displaying the length of line being retrieved. The counter 46 can be reset to zero by a separate manual knob or the resetting operation can be linked with operation of the drive-unit controlling switch 18. With the illustrated latter arrangment, the handle of the switch 18 is OFF in a central position, is movable clockwise to a RESET position that resets the counter, and is movable counterclockwise to an ON position for retrieving line onto the spool 12; see the switch positions marked on the housing 14 of FIG. 1.

As also shown in FIGS. 1 and 2, the primary line guide 22 is a closed hoop which a set of collapsible legs 20 support well spaced directly above the spool 12. The illustrated guide 22 has four pins 22*a* affixed to it which mate with corresponding socketlike apertures in the ends of the four legs 20, when the legs are fully extended as shown in FIG. 1. The legs 20 are pivotally mounted to the housing 14 at the deck panel 32 with ball-and-socket type fixtures 48 that allow each leg to be telescopically collapsed and aligned flat for storage directly above the deck panel as shown in FIG. 2, and as shown with dashed lines in FIG. 1. The legs are deployed by pivoting them upwards about their mounting fixtures and extending them to receive the mounting pins of the primary line guide, as shown in FIG. 1.

With the foregoing construction, the retriever 10 deploys the spool 12 and the primary line guide 22 parallel to one another and generally horizontal and concentric about the spool rotation axis. Further, the primary line guide is well spaced vertically above the spool. The spacing is greater than the spool diameter and typically is several times the spool diameter. Moreover, the diameter of the spool is relatively large, and it is also considered preferable that the primary line guide have a similar large inner diameter. A spool diameter greater than the order of five inches is found to operate well with the present geometry of elements, whereas a diameter greater than the order of fifteen inches is considered undesirable. By way of a preferred illustrative example, a retriever 10 according to the invention has a spool with a diameter at the cylindrical surface 12*c* in the order of ten inches, and the hoop which forms the primary line guide 22 is spaced approximately four times this distance above the spool. The included angle between the cylindrical surface 12*b* of the spool and the spool rim 12*c* is 135°; other constructions with an angle of 150° have also been successful. Further, the inner diameter of the hoop which forms the primary line guide is in the order of the spool diameter, i.e. ten inches.

The retriever is prepared for carrying and storage by disassembling the line guide 22 from the legs 20 and storing it, as on mounting clips 50 carried on the top 14*b* of the housing case. The legs are then collapsed and placed down along the housing deck panel 32. The cover 14*b* of the case can then be closed with all elements of the retriever compactly stored inside as FIG. 2 shows.

A further feature of the invention resides in the anchorage of the free end of the line 24 with a golf ball 26 or other like sports missile having a thermoplastic body. In accordance with this feature of the invention, this anchorage employs a barbed shaft 50, shown in FIG. 1, which is heated sufficiently to melt the material of the golf ball shell and core. The heated shaft is force-pressed radially into the golf ball until only the small eyelet 50*a* protrudes from the ball. As the shaft cools, the material of the ball which melted re-solidifies around the barbs and thereby anchors the shaft within the ball in a secure solid manner.

The illustrated shaft employs a straight stem 50*a* having an eyelet 50*b* at a head end and having a set of one or more barbs 50*c* laterally projecting from the stem.

The anchorage which this shaft construction and installation procedure provides inflicts minimal damage to a standard golf ball and yet is relatively easy to affect. It provides a strong and reliable conection of the golf ball to the tethering line 24 secured to the hook eyelet 50*b*.

The retriever construction described above and illustrated can be used with sports missiles other than a golf ball. For example, it can be used to retrieve such various sports missiles as baseballs, footballs, hockey pucks, and tennis balls, to name but a few. Whatever missile is used, the retriever affords practice in shots or throws in any selected directions and with any desired distance. By way of example, the retriever thus can be used in practicing a variety of golf shots, whether putting, chipping or driving. In each instance, the retriever readily enables the user to measure the distance by which the missile has travelled.

It will thus be seen that the objects set forth above, among those made apparent from the preceding description, are efficiently attained. Since certain changes may be made in the above construction without departing from the scope of the invention, it is intended that all matter contained in the above description or shown in the accompanying drawings be interpreted as illustrative and not in a limiting sense. By way of non-limiting example, although illustrated with both the second line guide 28 and the counter stem 44, the retriever 10 can employ either element alone to guide line 24 onto the spool 12 from the primary guide 22. Further, the metering unit 30 can be incorporated with the spool 12, to meter line length in response to the take-up rotation of the spool.

It is also to be understood that the following claims are intended to cover all of the generic and specific features of the invention herein described, and all statements of the scope of the invention which, as a matter of language, might be said to fall therebetween.

Having described the invention, what is claimed as new and secured by Letters Patent is:

1. Sports missile-retrieving apparatus comprising in combination

A. means forming a housing,

B. motor means mounted with said housing,

C. a spool member mountingly carried with said housing for generally horizontal deployment and for selective rotation by said motor means about a generally vertical spool axis, D. first line-guiding means forming a substantially planar line-guiding path, E. mounting means carried with the housing and being repeatedly extendable for supporting said first line-guiding means in a deployed position with said line-guiding path thereof substantially concentric with said spool member and with the plane of said path transverse to the axis of said spool member and spaced from said spool member by more than a fractional multiple of the spool diameter, said mounting means being repeatedly collapsible from said extended position for the storage of said first line-guiding means and of said mounting means compactly with said housing, F. a tethering line normally wound on said spool and having one end secured thereto and having means at the other end for attachment to a sports missile, and G. second line-guiding means carried with said housing aligned with the circumference of said spool member for guiding to the spool circumference said line feeding from said first line-guiding means during said selected rotation, said second line-guiding means being arranged for ready manual release of said line therefrom and for ready manual engagement of said line therewith, so that said line feeds off said spool element directly to said first line-guiding means and, conversely, feeds onto the spool circumference from said first line-guiding means by way of said second line-guiding means.

2. Apparatus as defined in claim 1 further comprising means forming a cylindrical line-spooling circumference on said spool, and a rim on said spool facing said deployed first line-guiding means with a rim surface obliquely angled relative to said spool circumference.

3. Apparatus as defined in claim 2 further characterized in that said rim surface is oriented at an angle at least in the order of three-halves pi radians from said spool circumference.

4. Apparatus as defined in claim 1 in which said first line-guiding means includes a closed hoop member forming said line-guiding path.

5. Apparatus as defined in claim 1 in which said mounting means includes plural telescopically collapsible leg elements arranged for extending between said housing and said first line-guiding means for the deployment thereof.

6. Apparatus as defined in claim 5 further comprising pivotal mounting means connecting each leg element with said housing for accommodating the collapsed storage of each leg element compactly with said housing and for accommodating extension of each leg element away from said housing for said deployment of said first line-guiding means.

7. Apparatus as defined in claim 1 further comprising line-metering means mounted with said housing and arranged for metering the length of line wound onto said spool element during said selected rotation thereof.

8. Apparatus as defined in claim 1 further comprising

A. a solid missile secured to said free end of said line, and

B. a barbed anchor pin fastened to said free end of said line and embedded into said solid missile by the process of heating said anchor pin sufficiently to melt material of said missile and pressing said heated pin into said missile.

9. Apparatus as defined in claim 1 in which said second line-guiding means includes at least a line-guiding eyelet or a line-engaged actuator for line-metering means.

10. Apparatus as defined in claim 1 further characterized in that said spool has a diameter at least in the order of five inches.

11. In sports missile retrieving apparatus having a housing, motor means mounted with the housing, a spool member mountingly carried with the housing for selective rotation about a spool axis by said motor means, and a tethering line with one end secured to the spool and normally wound on the spool and having means at the other end for attachment to a sports missile, the improvement characterized by A. said spool member being arranged for generally horizontal deployment and for said selective rotation about a generally vertical spool axis, B. first line-guiding means forms a substantially planar line-guiding path, C. mounting means carried with the housing and being repeatedly collapsible to a storage condition and repeatedly extendable to a deployed position, said mounting means in said collapsed position being disposed for compact storage with said housing and in said deployed condition supporting said first line-guiding means with said path thereof substantially concentric with said vertical spool axis and with the plane of said path transverse thereto, and spaced from said spool member by more than a fractional multiple of said spool diameter, and D. second line-guiding means carried with said housing aligned with the circumference of said spool member for guiding to the spool circumference said line leading feeding to said spool member from said first line-guiding means during said selected rotation, said second line-guiding means being arranged for ready manual release of said line therefrom and for ready manual engagement of said line therewith, so that said line feeds off said spool element directly to said first line-guiding means and feeds onto the spool circumference from said first line-guiding means by way of said second line-guiding means.

* * * * *